United States Patent [19]

Lombardini et al.

[11] Patent Number: 4,691,534

[45] Date of Patent: Sep. 8, 1987

[54] CRYOGENIC PUMP WITH REFRIGERATOR WITH THE GEOMETRY OF THE SHIELDS, SUITABLE FOR ACHIEVING A HIGH EFFICIENCY AND AN EXTENDED LIFE

[75] Inventors: Lapo Lombardini; Gianluca Bardi, both of Florence, Italy

[73] Assignee: Officine Galileo S.p.A., Italy

[21] Appl. No.: 843,102

[22] Filed: Mar. 24, 1986

[30] Foreign Application Priority Data

Mar. 26, 1985 [IT] Italy ..... 9373 A/85

[51] Int. Cl.[4] ..... B01D 8/00

[52] U.S. Cl. ..... 62/55.5; 55/269; 62/268; 417/901

[58] Field of Search ..... 62/55.5, 100, 268; 55/269; 419/901

[56] References Cited

U.S. PATENT DOCUMENTS

| | | | |
|---|---|---|---|
| 4,295,338 | 10/1981 | Welch | 62/55.5 |
| 4,325,220 | 4/1982 | McFarlin | 62/55.5 |
| 4,494,381 | 1/1985 | Lessard | 62/55.5 |
| 4,530,213 | 7/1985 | Kadi | 62/55.5 |

*Primary Examiner*—Ronald C. Capossela

*Attorney, Agent, or Firm*—McGlew and Tuttle

[57] ABSTRACT

A cryogenic pump with a two stages refrigerator, an access grid and condensation walls partially coated by adsorbing material and thermally connected to the second stage of the cryogenic generator, which walls are formed by one or more metallic strips so shaped as to slant considerably in respect to the axis of the cylindrical shield and completely covered by an adsorbing material on both faces; said walls are protected by shielding surfaces at least outside reflecting.

4 Claims, 2 Drawing Figures

Figure 1:
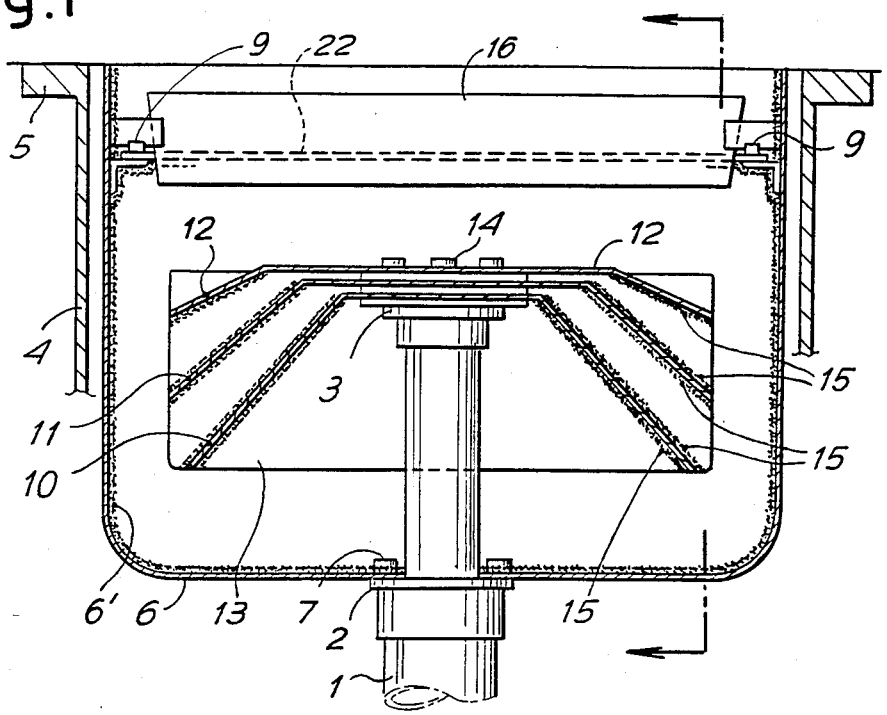

CRYOGENIC PUMP WITH REFRIGERATOR WITH THE GEOMETRY OF THE SHIELDS, SUITABLE FOR ACHIEVING A HIGH EFFICIENCY AND AN EXTENDED LIFE

DESCRIPTION

This invention relates to a cryogenic pump whose shields are cooled by a double stage cryogenic generator, in a closed circuit, by thermal contact with this latter. The pumping of the gases is based upon the condensation action of the molecules on the shields at cryogenic temperatures. The achievable final pressure is the lower the minor is the temperature reached by the condensation shields thermally connected to the second stage of the cryogenic generator.

The final temperatures of the shields are determined by the energy balance of the cryogenic power available from the cryogenic generator and the thermal loads coming from the outside. Among these, the thermal load caused by radiation and acting on the shields of the second stage can be minimized by resorting to an antiradiation that is a radiation shielding shield thermally connected to the flange of the first stage of the cryogenic generator. By this way, the shields surfaces of the second stage receive a much lower thermal radiation, since it originates from a surface that is at a cryogenic temperature too.

The shield of the first stage is normally realized by a shell having cylindrical geometry and by a grid connected therewith by a good thermal contact, whose function is to prevent the thermal radiation, coming from the ambient temperature, from reaching the second stage shields, while allowing in addition the passage of the gas molecules.

As it is known the cryogenic pumping of the gases takes place selectively, since each type of gas at an established pressure condenses at a well fixed temperature. Normally the steam is pumped over the shield of the first stage, which in addition to the antiradiation function has also this latter purpose. Most of the other gases—Nitrogen, Argon, Oxygen and others—are pumped on the shields of the second stage, after that the molecules of these gases have crossed the grid of the first stage.

At the temperatures and pressures normally achievable by cryogenic pumps of this type (15° K.), it is anyway not possible to pump through condensation Helium, Nitrogen and Neon. Therefore usually for these gases a different technique of cryogenic pumping is used, which resorts to the molecular adsorption of these gases through the use of special materials. These latter exert an action being the more efficacious the lower is the temperature at which they are cooled.

As is known, the pumping capacity related to the not condensable gases is defined as the maximum amount of gases adsorbed by the special materials, in order to reach the saturation of the same materials. Therefore the capacity will be the higher the larger the shields surface covered by said materials.

One way to reach high capacity values is to maximize the surface of the second stage shields that is covered by the above mentioned materials. This generally involves an unwanted increase of the times necessary to the cryogenic generator, for the cooling of the same shields up to the cryogenic temperatures. In order to avoid a considerable reduction of the capacity values of not condensable gases, the surfaces covered by the adsorbing material are placed in zones protected against the direct flow of the gas molecules.

The object of this invention is to provide a cryogenic pump having such a geometry of the second stage shields that the extension of the surfaces covered by adsorbing material is maximized, without causing in this way a considerable increase of the time necessary to cool the same surfaces. Moreover said second stage surfaces can be built in a relatively simple way and can be economically realized.

The main characteristic of the invention is a particular geometry of the second stage shields: these shields are realized by some metallic strips, suitably shaped and covered by adsorbing material, which because of their shape can be superimposed, with a good thermal contact with each other and with second stage of the cryogenic generator, so that a considerable surface is offered to the adsorbing material, although limited overall dimensions are maintained.

Due to the modular construction of said elements, they can be assembled in a variable number, depending on the operation needs. For the applications wherein considerable amounts of not condensable gases are involved, the number of said elements can be increased.

In order to prevent the gases that condense at the second stage temperatures (Argon, Oxygen, Nitrogen, etc.) from contaminating the adsorbing materials and in order to offer to these gases a wide condensation surface, the above mentioned metallic strips are surrounded by a metallic shield, being in good thermal contact with said strips and with the second stage of the cryogenic generator, which shield is suitably shaped in such a way that it surrounds said strips.

The shaping of said shield is also such that it permits an easy affluence of the not condensable gases over the adsorbing material on the whole surface thereof, so that an uniform diffusion is allowed and consequently the adsorption process is optimized. In fact, as it is known, in the traditional cryogenic pumps—with a circular and not circular geometry, having the surfaces of the second stage made by cylindrical or plane-parallel walls said process of adsorption preferably concentrates at the inlet edges of the zones covered by the adsorbing material, which thus is not completely utilized.

Figure 2:
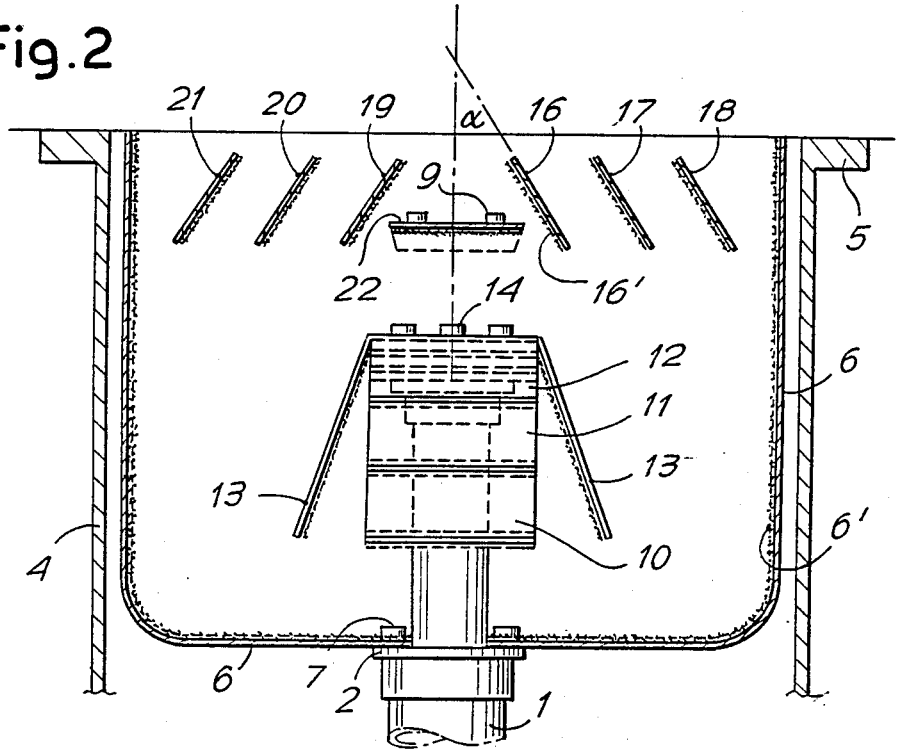

The invention will be better understood by following the description and the enclosed drawing, that shows a practical not limitative exemplification of the same invention. In the drawing:

FIGS.1 and 2 show two sections of the cryogenic pump, being orthogonal to each other.

In FIG.1 the arrangement is shown of the surfaces forming the shields of the cryogenic pump. In FIG. 1 the appendix of the cryogenic generator at the central position, wherein the cryogenic effect takes place, is indicated by 1 and the flanges related to the first and second stage are indicated by 2 and 3 respectively.

The whole cryogenic pump is surrounded by a flanged cylinder 4, at the ambient temperature, which is vacuum tight, and whose end flange 5 permits the fastening to the utilization chamber (not illustrated). The cylinder 4 emits a radiation that invests an antiradiation shield 6, thermally connected to the flange 2 of the first stage of the cryogenic generator through screws 7; to said shield there is also connected, by screws 9, a shielding grid, which includes one or more groups of metallic strips parallel to each other, suitably slanting of an angle $\alpha$ in respect to the axis of the antiradiation shield (see FIG. 2); this grid crosses the whole inlet section of the cylindrical shield 6. Said shielding grid of the first stage, which is thermally connected to the antiradiation shield 6 through the fastening screws 9, is formed—in the example of FIG. 2—by two symmetrical groups of metallic strips 16, 17, 18 and 19, 20, 21, and by a central strip 22 being the shields of each group parallel to each other, and slanting of an angle $\alpha$ in respect to the axis of the antiradiation shield; the strips cross the whole inlet section of the shield 6. The surfaces facing the outside of strips 16 to 22, along with those of the shield 6, are externally shining, while the internal surfaces are internally black and opaque; by 6' and 16' the black opaque treatment of the shield 6 and the strips is indicated. On FIG. 1 only one of the strips is visible, being indicated by 16.

The reason why both the surfaces of the shield 6 and those of the slatsor strips 16 to 22 of the grid are treated in such away that they result externally shining and internally black opaque, is to attain the reduction of the thermal loads caused by radiation.

The second stage surfaces are formed by strips 10, 11, 12, this latter forming at its sides two closing shields 13. The strips 10, 11, 12 with the shields 13 are fastened to the flange 3 of the second stage through screws 14, with a good thermal contact with each other and with the flange itself.

The strips 10, 11 are completely covered by the adsorbing material 15 and then they offer a wide surface for the gases adsorption. The strip 12 is coated by material 15 on the lower face only of the strip, while externally, that is at the upper side, said strip 12 is treated in such a way that it results shining, in order to reduce the thermal loads caused by radiation. The shields 13 have a central zone that is connected without interruption to the strip central zone, and they flank at opposite sides the strips 10, 11, 12 in the external zones thereof inclined downwards. The outside surfaces of the shields 13 are externally shining for the reasons already above specified, and at the inside each shield 13 can be covered or not covered by adsorbing material.

The active surfaces of the second stage are thus represented by the zones of the strips 10, 11 and 12 and possibly by the internal faces of the shields 13. The outside surfaces of the strip 12 and the shields 13 form a shining shielding that reduces the thermal load on the second stage. The components 10, 11, 12 and 13 are fastened with a good thermal contact to the flange of the second stage through screws 14.

The morphology of the second stage assures high efficiency and extended operation life, before a saturation of the covering adsorbent material 15 takes place.

We claim:

1. A cryogenic pump having a cooling stage with a refrigeration temperature of from 70° to 80° K., at least one second stage connected to said first stage with a refrigeration temperature of from 12° to 15° K., a cylindrical shield having a closed end mounted on said first stage and extending above said second stage and having an opened end with an inlet grid extending across said opened end, said grid having spaced apart obliquely extending laterally spaced planar panels, said shield having condensation walls, said condensation walls and said planar panels comprising at least one metal strip and completely covered by absorbing material on both faces, said strips having externally reflecting surfaces, and a plurality of second stage planar panels connected to said second stage and being of a light metallic mass with at least one being disposed parallel to the axis of said second stage and at least one of said second stage panels extending at an angle to the axis of said second stage, and second stage metal strips covering said second stage panels.

2. A cryogenic pump as per claim 1, wherein the strips forming the condensation shield of the second stage are separate and can be superimposed according to a modular way in a variable number.

3. A cryogenic pump as per claim 1, including a closing shield above said second stage metallic strips covered by adsorbing material of the second stage, and formed by a further strip having the same trend as said strips and being internally covered by adsorbing material and by two plane side metallic sheets, being shaped, slanting in respect to the axis of the cylindrical shield, and symmetrically placed at the outside of the ensemble formed by the strips.

4. A cryogenic pump as per claim 3, wherein the inlet grid includes plane metallic strips, mutually parallel and symmetrically slanting in respect to the axis of the cylindrical shield, with the external surface that is shining and the internal surface that is black opaque, characterized in that the ensemble formed by the metallic strips (10, 11, 12) of the second stage is developed according to the direction of the longitudinal axis of the strips (16 to 22) forming the grid of the first stage.

* * * * *